US007462987B2

(12) United States Patent
Jang et al.

(10) Patent No.: US 7,462,987 B2
(45) Date of Patent: Dec. 9, 2008

(54) PLASMA DISPLAY PANEL

(75) Inventors: Sang-Hun Jang, Suwon-si (KR); Hidekazu Hatanaka, Suwon-si (KR); Young-Mo Kim, Suwon-si (KR); Zeng Xiaoqing, Suwon-si (KR); Hyoung-Bin Park, Suwon-si (KR); Seung-Hyun Son, Suwon-si (KR); Seong-Eui Lee, Suwon-si (KR); Gi-Young Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 463 days.

(21) Appl. No.: 11/208,780

(22) Filed: Aug. 23, 2005

(65) Prior Publication Data

US 2006/0055312 A1 Mar. 16, 2006

(30) Foreign Application Priority Data

Aug. 24, 2004 (KR) ..... 10-2004-0066711

(51) Int. Cl.
*H01J 63/04* (2006.01)

(52) U.S. Cl. ..... 313/584; 313/582; 313/583; 313/585; 313/586; 313/587

(58) Field of Classification Search ..... 313/582–587; 315/169.3, 169.4; 345/60, 30, 37; 445/24–25
See application file for complete search history.

(56) References Cited

U.S. PATENT DOCUMENTS

| | | | | |
|---|---|---|---|---|
| 4,638,218 | A | 1/1987 | Shinoda et al. | 315/169.4 |
| 5,557,168 | A * | 9/1996 | Nakajima et al. | 313/586 |
| 5,661,500 | A | 8/1997 | Shinoda et al. | 345/60 |
| 5,744,909 | A * | 4/1998 | Amano | 313/585 |
| 7,067,979 | B2 * | 6/2006 | Sakamoto | 313/584 |
| 2001/0026129 | A1 * | 10/2001 | Ahn et al. | 313/586 |
| 2002/0003405 | A1 * | 1/2002 | Kang | 313/586 |
| 2002/0130619 | A1 * | 9/2002 | Mori et al. | 313/585 |
| 2002/0179579 | A1 * | 12/2002 | Lin et al. | 219/121.52 |
| 2004/0245929 | A1 * | 12/2004 | Sakamoto | 313/584 |
| 2005/0007018 | A1 * | 1/2005 | Akiba | 313/583 |

FOREIGN PATENT DOCUMENTS

| | | | |
|---|---|---|---|
| EP | 1077466 | | 2/2001 |
| JP | 02223133 | | 9/1990 |
| JP | 03201342 | | 9/1991 |
| KR | 10-0279255 | B1 * | 10/2000 |
| KR | 10 2001004713.1 | * | 6/2001 |

OTHER PUBLICATIONS

European Search Report dated Jan. 16, 2006.

* cited by examiner

*Primary Examiner*—Joseph L. Williams
*Assistant Examiner*—Elmito Breval
(74) *Attorney, Agent, or Firm*—H.C. Park & Associates, PLC

(57) ABSTRACT

A plasma display panel including first and second substrates facing each other, a first electrode pair that is arranged on the first substrate and that induces a mutual discharge, and a second electrode pair that is arranged substantially parallel to the first electrode pair and that induces a mutual discharge.

29 Claims, 11 Drawing Sheets

PLASMA DISPLAY PANEL

CROSS-REFERENCE TO RELATED PATENT APPLICATION

This application claims priority to and the benefit of Korean Patent Application No. 10-2004-0066711, filed on Aug. 24, 2004, which is hereby incorporated by reference for all purposes as if fully set forth herein.

BACKGROUND OF THE INVENTION

1. Field of the Invention

The present invention relates to a plasma display panel (PDP), and more particularly, to a PDP having high efficiency, high contrast ratio, and durability.

2. Discussion of the Background

U.S. Pat. Nos. 4,638,218 and 5,661,500 disclose a surface discharge PDP including a structure where sustain discharge occurs between two electrodes formed on a front substrate.

Discharge occurs between electrodes formed on the same substrate in a surface discharge PDP. Since the PDP's discharge sustain electrodes may be formed on the front substrate, a transparent material is formed on a light passing portion in a pixel region. Indium tin oxide (ITO) is a transparent conductive material that is widely used as a transparent electrode material. Since transparent material such as ITO typically has high resistance, it is partially used for a plasma discharge region, and the electrical signal transmission to the ITO electrode may be performed through metallic bus lines.

FIG. 1 is a schematic perspective view showing a typical structure of a surface discharge PDP, and FIG. 2 is a schematic cross-sectional view showing the discharge cell structure thereof. The upper substrate of FIG. 2 is shown rotated 90 degrees to help understand the discharge structure.

Referring to FIG. 1 and FIG. 2, a plurality of pairs of transparent discharge sustain electrodes 13*a* and 13*b* are arranged on an inner surface of a first substrate 10 in parallel with each other. Metallic bus electrodes (not shown) may be formed on the discharge sustain electrodes 13*a* and 13*b*. A dielectric layer 11 covers the discharge sustain electrodes 13*a* and 13*b*, and a protective layer 12, which may be made of MgO or the like, covers the dielectric layer 11. Additionally, a plurality of barrier ribs 21 having a predetermined height are formed parallel to each other on an inner surface of a second substrate 20, and they extend in the direction perpendicular to the discharge sustain electrodes 13*a* and 13*b*. Address electrodes 22 are arranged on a surface of the second substrate 20 and between the barrier ribs 21. A dielectric layer 23 covers the address electrodes 22. As shown in FIG. 2, a phosphor layer 24 is formed on side walls of the barrier ribs 21 and an upper surface of the dielectric layer 23.

In the surface discharge PDP, an initial discharge is induced by one sustain electrode and one address electrode, and the discharge is sustained by the sustain electrodes. Ultra-violet (UV) light generated in a discharge region is absorbed by the phosphor layer 24, thereby exciting the phosphor layer 24.

A shortcoming of the conventional PDP is that it typically has low discharge efficiency, which is caused by a short discharge distance and the planar electrode arrangement. Additionally, since the discharge is generated close to the front first substrate 10 of the PDP, ions generated therefrom may collide with, and damage, the protective layer 12, which shortens the PDP's lifetime. In addition, the phosphor layer 24 is formed on the rear second substrate 20 spaced apart from the discharge region, so that a relatively large amount of the UV light generated from the discharge region close to the first substrate 10 may not be absorbed by the phosphor layer 24.

SUMMARY OF THE INVENTION

The present invention provides a plasma display panel (PDP) having high brightness and high discharge efficiency.

Additional features of the invention will be set forth in the description which follows, and in part will be apparent from the description, or may be learned by practice of the invention.

The present invention discloses a PDP including first and second substrates facing each other, and a plurality of discharge cells between the first substrate and the second substrate. A discharge cell includes a first electrode pair and a second electrode pair. The first electrode pair is arranged on the first substrate and induces a mutual discharge, and the second electrode pair is arranged substantially parallel to the first electrode pair and induces a mutual discharge.

The present invention also discloses a PDP including first and second substrates facing each other, a plurality of barrier ribs arranged substantially parallel to each other and between the first and second substrates, a first electrode pair that is arranged on the first substrate and that induces a mutual discharge, ridges arranged on the second substrate, a second electrode pair that is arranged substantially parallel to the first electrode pair and that induces a mutual discharge, and an address electrode arranged on the second substrate in a direction substantially perpendicular to the first and second electrode pairs. At least one electrode of the second electrode pair is arranged on a ridge.

The present invention also discloses a PDP including first and second substrates facing each other, a plurality of barrier ribs arranged between the first and second substrates and having a step-shaped cross section formed by a wide lower portion and a narrow upper portion, a first electrode pair that is arranged on the first substrate and that induces a mutual discharge, a second electrode pair that is arranged substantially parallel to the first electrode pair and that induces a mutual discharge, and an address electrode arranged in a direction substantially perpendicular to the first and second electrode pairs. Both electrodes of the second electrode pair are arranged on the lower portion of a barrier rib.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
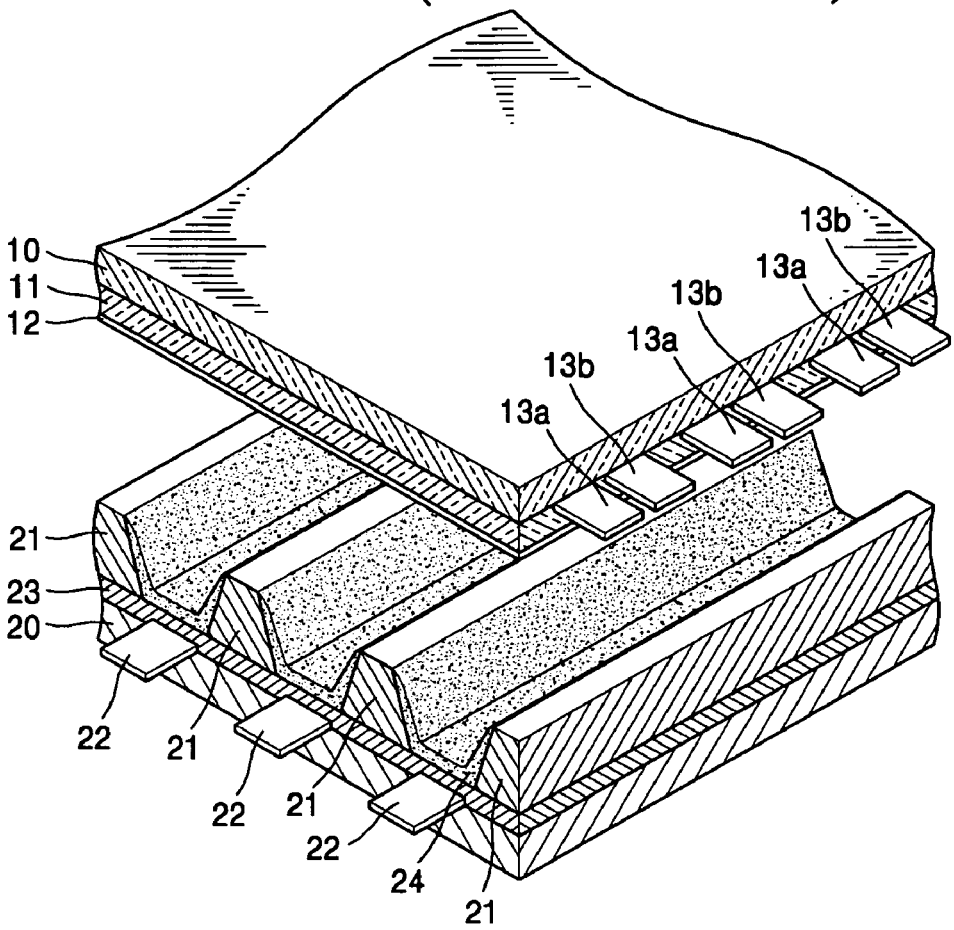
FIG. 1 (PRIOR ART)
FIG. 1 is a schematic perspective view of a conventional three-electrode surface discharge plasma display panel (PDP).

A plasma display panel (PDP) according to exemplary embodiments of the present invention will be described in detail with reference to the accompanying drawings. This invention may, however, be embodied in many different forms and should not be construed as limited to the embodiments set forth herein. Rather, these embodiments are provided so that this disclosure is thorough, and will fully convey the scope of the invention to those skilled in the art.

In the drawings, the thicknesses of layers and regions are exaggerated for clarity. It will also be understood that when a layer is referred to as being "on" another layer or substrate, it can be directly on the other layer or substrate, or intervening layers may also be present. Like reference numerals designate like elements throughout the specification.

Figure 3:
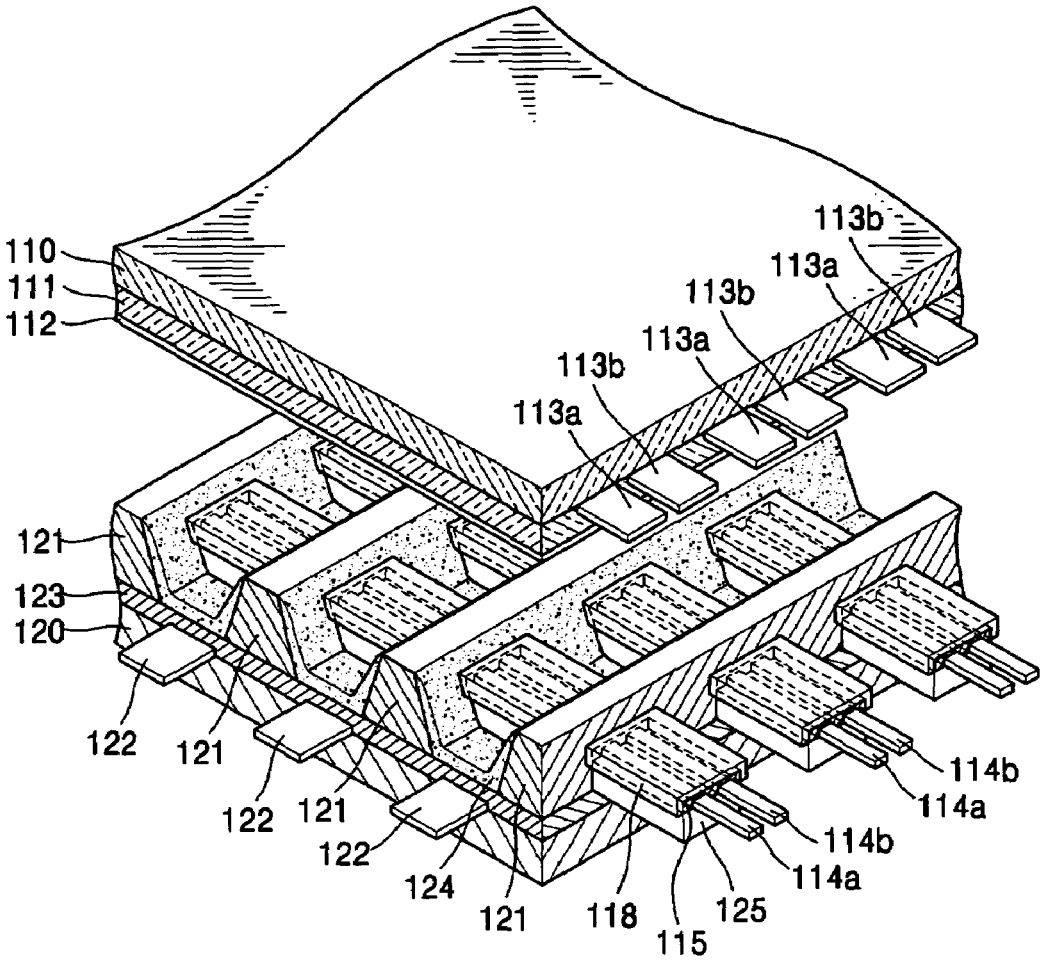
FIG. 3 is a schematic perspective view of a PDP according to a first exemplary embodiment of the present invention.
Figure 4:
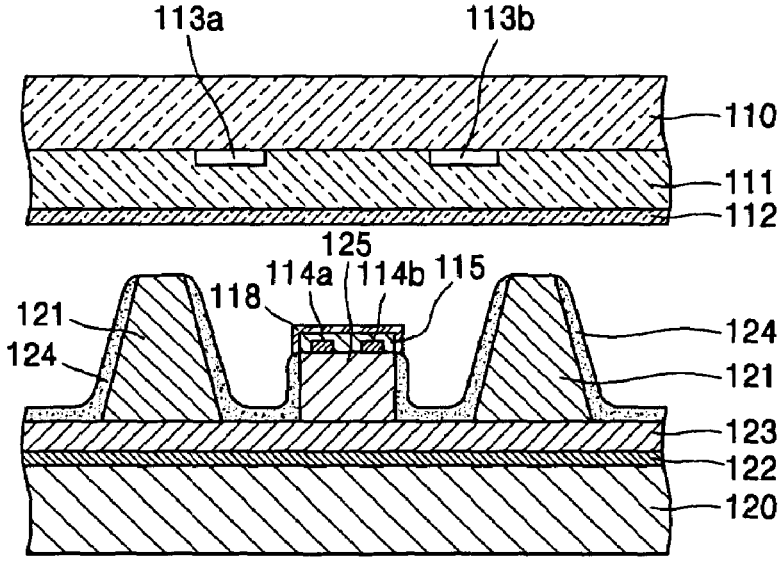
FIG. 4 is a schematic cross-sectional view of the PDP of FIG. 3.

FIG. 3 is a schematic perspective view of a surface discharge PDP according to a first exemplary embodiment of the present invention, and FIG. 4 is a schematic cross-sectional view showing a discharge cell structure of the PDP of FIG. 3.

Referring to FIG. 3 and FIG. 4, a plurality of transparent, first discharge sustain electrode pairs, including electrodes 113*a* and 113*b*, capable of inducing mutual sustain discharge (i.e. a sustain discharge may be generated between the electrodes 113*a* and 113*b*) are formed on an inner surface of the first substrate 110. Metal electrodes (not shown) may be arranged on the first discharge sustain electrode pairs 113*a* and 113*b*. A first dielectric layer 111 covers the first discharge sustain electrode pairs 113*a* and 113*b*, and a first protective layer 112, which may be made of, for example, MgO, covers the first dielectric layer 111. Additionally, a plurality of barrier ribs 121 having a predetermined height are formed substantially parallel to each other on an inner surface of a second substrate 120, and they extend in a direction substantially perpendicular to the first discharge sustain electrode pairs 113*a* and 113*b*. Address electrodes 122 are formed on a surface of the second substrate 120 and are arranged between barrier ribs 121. A dielectric layer 123 covers the address electrodes 122.

As shown in FIG. 4, a phosphor layer 124 is formed on side walls of the barrier ribs 121 and on an inner surface of the dielectric layer 123 located between the barrier ribs 121. Second discharge sustain electrode pairs 114*a* and 114*b* are formed separated a predetermined height above an inner surface of the second substrate 120, and a second dielectric layer 115 covers the second discharge sustain electrode pairs 114*a* and 114*b*. The second discharge sustain electrode pairs 114*a* and 114*b* and the second dielectric layer 115 are formed on ridges 125 so that they may be spaced apart from the inner surface of the second substrate 120 to be close to the first substrate 110. In order to protect the dielectric material, a second protective layer 118, which may be made of MgO, covers the second dielectric layer 115.

The ridges 125 have a predetermined height and are arranged on the inner surface of the second substrate 120 in a direction substantially parallel to the first discharge sustain electrode pairs 113*a* and 113*b* and substantially perpendicular to the barrier ribs 121, as shown in FIG. 3. Therefore, the barrier ribs 121 and the ridges 125 are formed in a matrix structure, and the barrier ribs 121 are higher than the ridges 125. Accordingly, the ridges 125 are buried by the barrier ribs 121 at portions where the ridges 125 and the barrier ribs 121 intersect each other. The ridges 125 may be made of substantially the same dielectric materials that comprise a dielectric layer, such as the dielectric layer 123. Further, the ridges 125 may be formed by an etching method, a sandblasting method, or other like methods. The barrier ribs 121 and the ridges 125 are illustrated to be parallel to each other in FIG. 4 to help with understanding the discharge cell structure. However, the barrier ribs 121 are substantially perpendicular to the ridges 125, as FIG. 3 shows, and as described above. In the first exemplary embodiment, the gap between the first discharge sustain electrodes 113*a* and 113*b* is greater than the gap between the second discharge sustain electrodes 114*a* and 114*b*.

The second discharge sustain electrode pairs 114*a* and 114*b* may be formed of a metallic material. They need not be formed of a transparent material since light generated by the phosphor layer 24 does not transmit through the second discharge sustain electrode pairs 114*a* and 114*b*. For example, the second discharge sustain electrode pairs 114*a* and 114*b* may be made of silver (Ag) or chrome-copper-chrome (Cr/Cu/Cr).

Figure 5A:
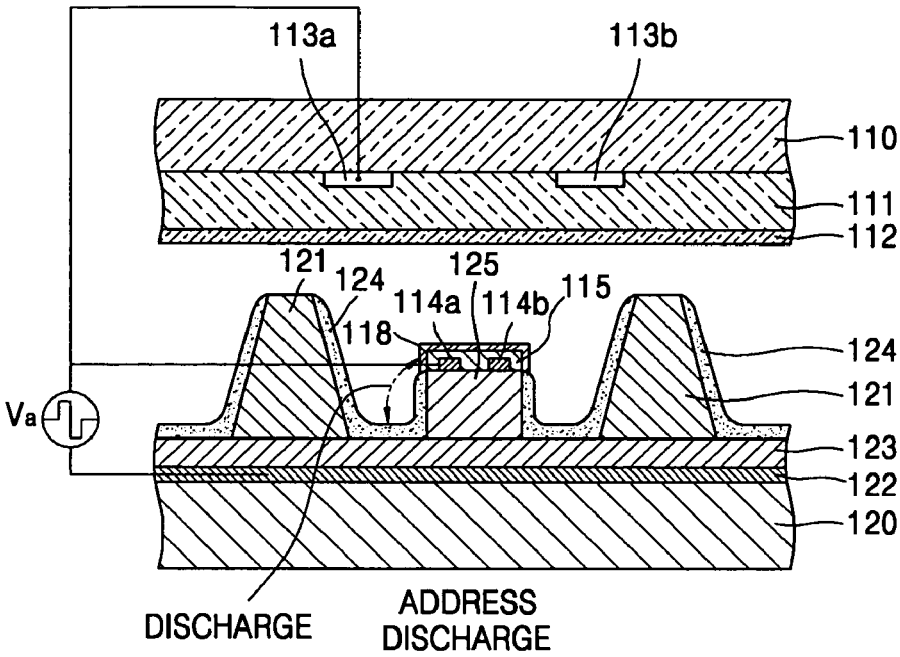
FIG. 5A and FIG. 5B show an address discharge and sustain discharge, respectively, of the PDP according to the exemplary embodiment of the present invention shown in FIG. 3 and FIG. 4.
Figure 5B:
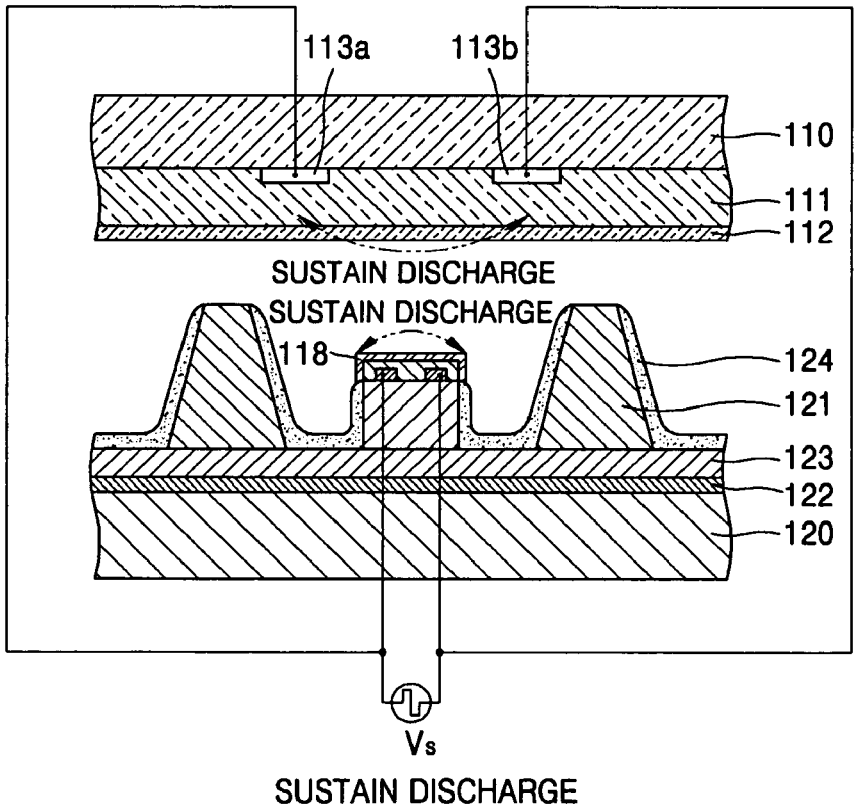

FIG. 5A and FIG. 5B are views for explaining the operation of a PDP according to an embodiment of the present invention. In particular, FIG. 5A shows an address discharge, and FIG. 5B shows a sustain discharge.

As shown in FIG. 5A, applying an address voltage Va between the address electrode 122 and the second discharge sustain electrode 114*a*, which is selected from the second discharge sustain electrode pair 114*a* and 114*b*, generates an address discharge between the address electrode 122 and the second discharge sustain electrode 114*a* of the corresponding discharge cell. Here, since the second discharge sustain electrode 114*a* and the address electrode 122 are close to each other, address discharge may be generated at a lower discharge voltage than that of a conventional PDP. At this time, since the same voltage is also applied to the first discharge sustain electrode 113*a*, electric fields are generated between the address electrode 122 and second discharge sustain electrode 114*a*, as well as between the first discharge sustain electrode 113*a* and the address electrode 122. However, since the second discharge sustain electrode 114*a* and the address electrode 122 are closer to each other, the address discharge occurs between them and then may spread toward the first discharge sustain electrode 113*a* due to the generated charged particles.

As shown in FIG. 5B, after the address discharge, applying a discharge sustain voltage Vs between the first discharge sustain electrode pairs 113*a* and 113*b*, and between the second discharge sustain electrode pairs 114*a* and 114*b*, generates a sustain discharge between the first discharge sustain electrode pairs 113*a* and 113*b* and a sustain discharge between the second discharge sustain electrode pairs 114*a* and 114*b*. In other words, the first discharge sustain electrode pairs 113*a* and 113*b* generate a first sustain discharge in a portion of the discharge cell that is closer to the first substrate 110, and the second discharge sustain electrode pairs 114*a* and 114*b* generate a second sustain discharge in a portion of the discharge cell that is closer to the ridges 125. The first and second sustain discharges occur substantially in parallel to each other, and they are surface discharges.

The occurrence of two sustain discharges in a unit discharge cell is a feature of the present invention. In particular, the second sustain discharge occurs in an intermediate portion between the first and second substrates 110 and 120.

Figure 6:
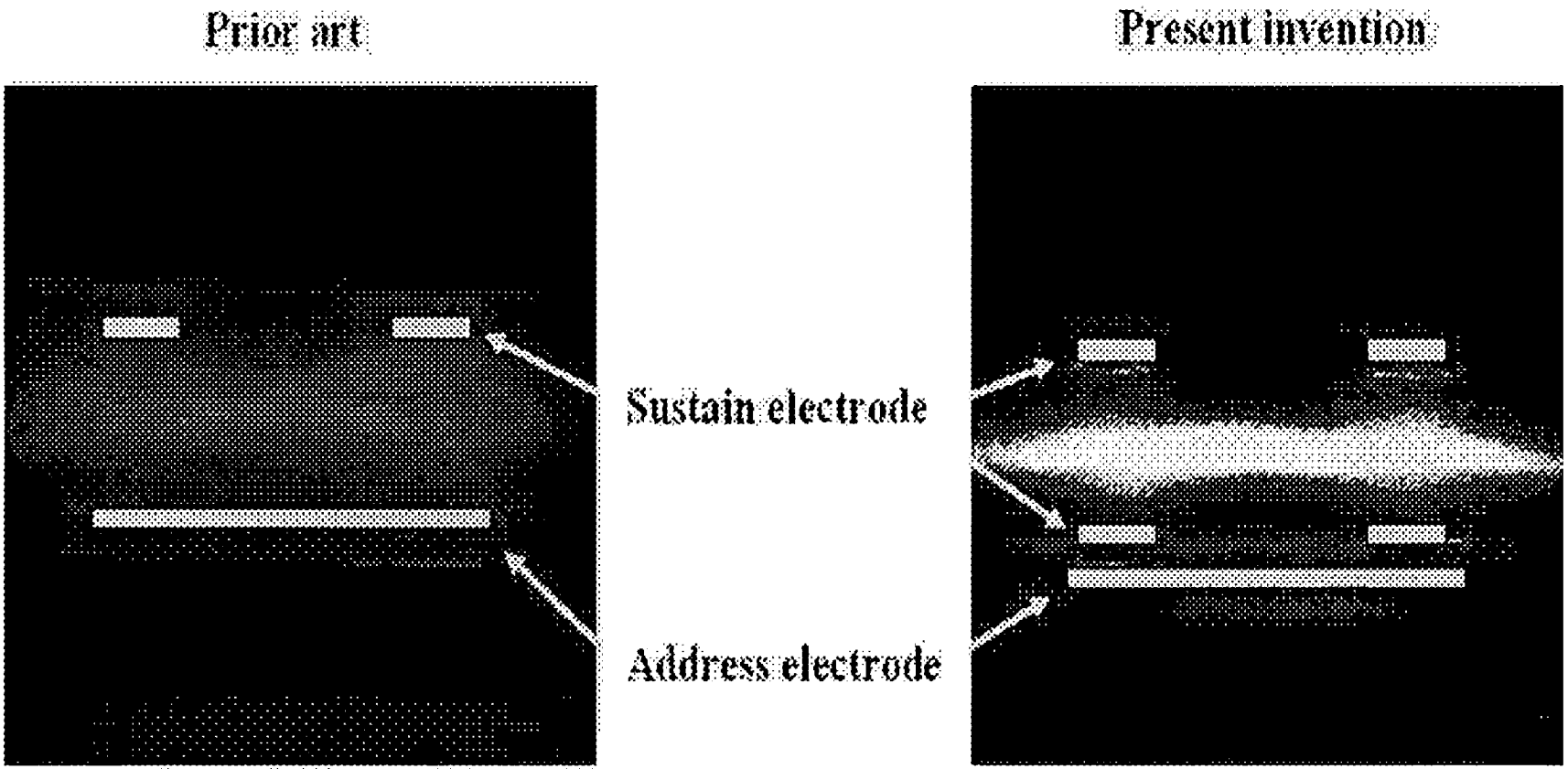
FIG. 6 shows simulation results of discharges of a conventional three-electrode PDP and the PDP according to an exemplary embodiment of the present invention shown in FIG. 3, FIG. 4 and FIG. 5.

FIG. 6 shows simulation results of discharges of a conventional three-electrode surface discharge PDP and a five-electrode surface discharge PDP according to an exemplary embodiment of the present invention.

Referring to discharge characteristics of the conventional PDP shown in FIG. 6, it can be seen that the discharge may be generated in a small region and is deflected to the first substrate (front substrate). However, according to an exemplary embodiment of the present invention, a stronger discharge may be generated. Additionally, the stronger discharge is wide, and it is located in a central portion of the discharge cell between the first and second substrates without substantial deflection, so that the phosphor material may be more uniformly excited as a whole.

Further, according to exemplary embodiments of the present invention, a substantially uniform discharge may be obtained over a wider range, and particularly, the discharge region may be spaced farther apart from the protective layer than the conventional discharge region. Hence, damage to the protective layer may be reduced. In particular, as can be understood from FIG. 6, according to exemplary embodiments of the present invention, it is possible to induce a higher intensity discharge than in a conventional PDP.

Figure 7A:
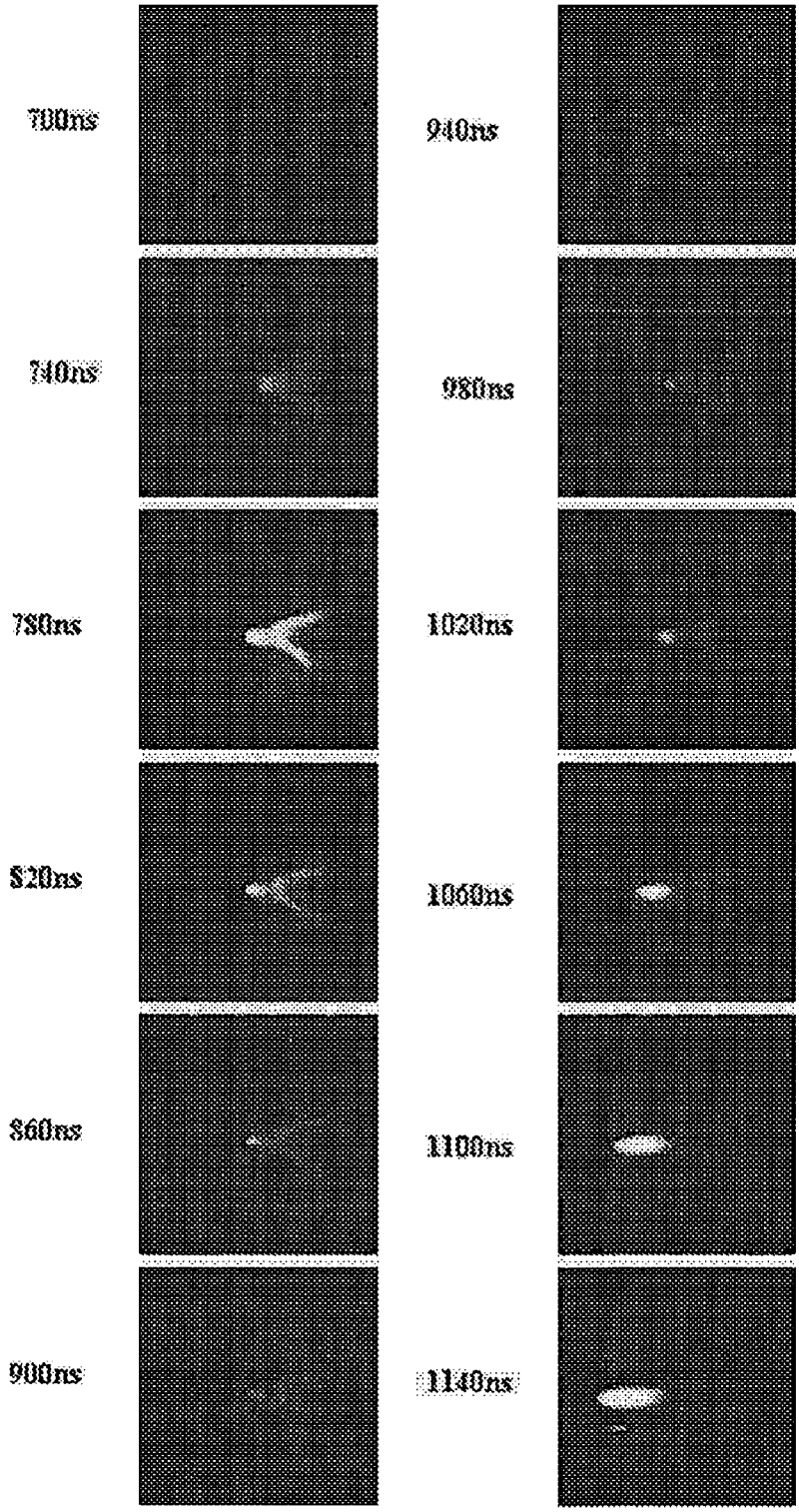
FIG. 7A and FIG. 7B show a time discharge proceeding structure of the PDP according to the first exemplary embodiment of the present invention.
Figure 7B:
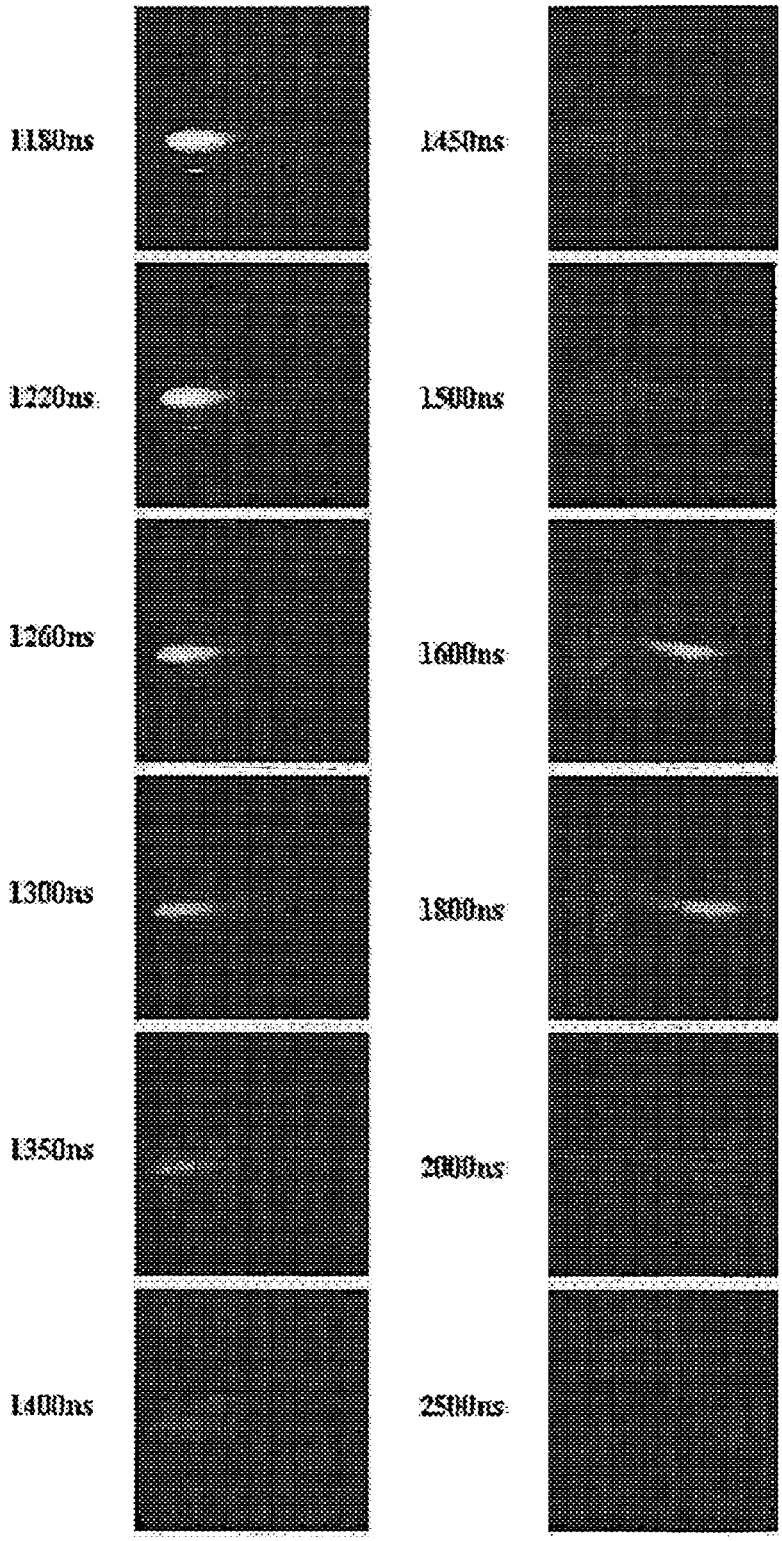

FIG. 7A and FIG. 7B show a discharge mechanism of the PDP according to an exemplary embodiment of the present invention and discharge process from start to end.

Referring to FIG. 7A, when applying a discharge voltage to the upper and lower sustain electrode pairs, discharge does not occur at a position in time of 700 ns, while a strong discharge may be initiated at a position in time of 740 ns when a first electric field generated by the two upper electrodes and a second electric field generated by the two lower electrodes contact, and a portion of the discharge propagates toward the upper and lower sustain electrodes. Thereafter, the discharge may be sustained along the electric field of the cell space. Like this, in a case where the electric field is concentrated on the discharge cell, discharge may be initiated earlier than in a conventional structure, and generated vacuum UV rays may be more uniformly distributed in the interior of the cell as compared with the conventional three-electrode surface discharge type PDP, so that the phosphor material may be more efficiently excited. Furthermore, since two sustain electrode pairs are arranged in the discharge cell, damage of the protective layer due to ions generated as a result of the discharge may be reduced, which increases the PDP's lifetime.

A PDP according to embodiments of the present invention may have various structures, examples of which are described below.

Figure 8:
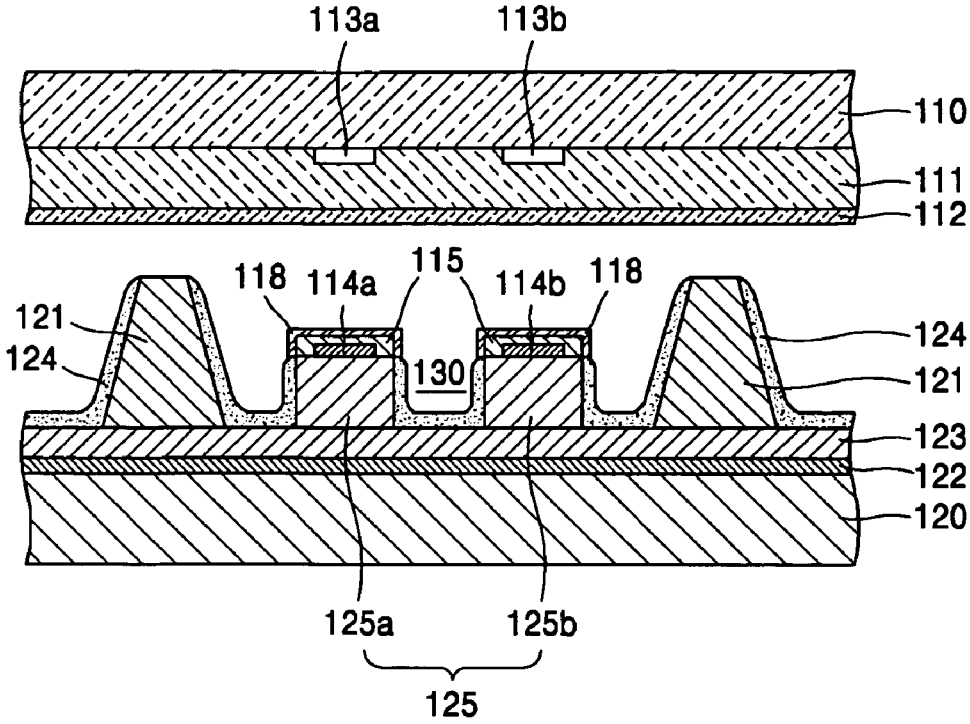
FIG. 8 is a schematic cross-sectional view of a PDP according to a second exemplary embodiment of the present invention.
Figure 9:
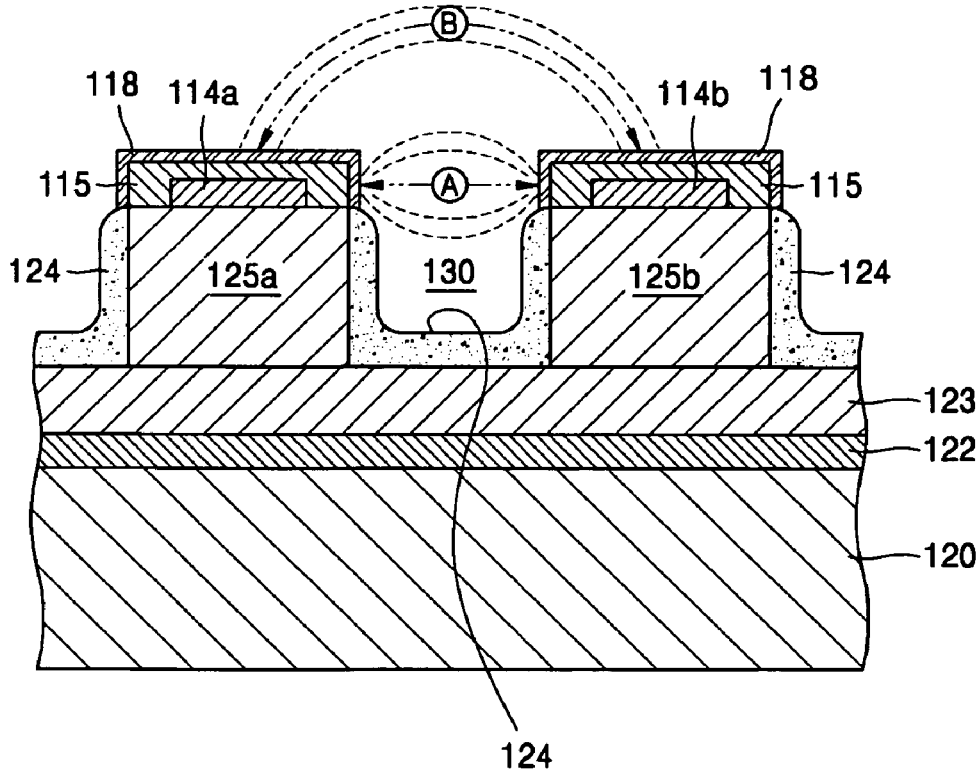
FIG. 9 is a partial enlarged view of the PDP of FIG. 8.

FIG. 8 and FIG. 9 illustrate a PDP according to a second exemplary embodiment of the present invention.

Referring to FIG. 8 and FIG. 9, a ridge 125 is divided into individual ridges 125*a* and 125*b*, and the second discharge sustain electrodes 114*a* and 114*b* are formed on the ridges 125*a* and 125*b*, respectively. Additionally, the gap between the second discharge sustain electrodes 114*a* and 114*b* is wider than that of the embodiment of FIG. 3 and FIG. 4. As shown in FIG. 8, the gap between first discharge sustain electrodes 113*a* and 113*b* may be substantially equal to the gap between the second discharge sustain electrodes 114*a* and 114*b*. The barrier ribs 121 and the ridges 125 are illustrated to be parallel to each other in FIG. 8 to help with understanding the discharge cell structure. However, the barrier ribs 121 are substantially perpendicular to the ridges 125, as shown in FIG. 3.

As FIG. 9 shows, the second discharge sustain electrodes 114*a* and 114*b* are raised from a second substrate 120 with a predetermined height by the individual ridges 125*a* and 125*b*, and a space 130, substantially having a valley-like shape, is formed between the individual ridges 125*a* and 125*b* for a second sustain discharge. Due to the valley-shaped space 130, the discharge between the second discharge sustain electrodes 114*a* and 114*b* is a combination of a surface discharge B between surfaces of the second discharge sustain electrodes 114*a* and 114*b* and a facing discharge A between facing edges of the second discharge sustain electrodes 114*a* and 114*b*. The phosphor layer 124 is formed on sides of the barrier ribs 121 and on an upper surface of the dielectric layer 123, including within the valley-shaped space 130.

Figure 10A:
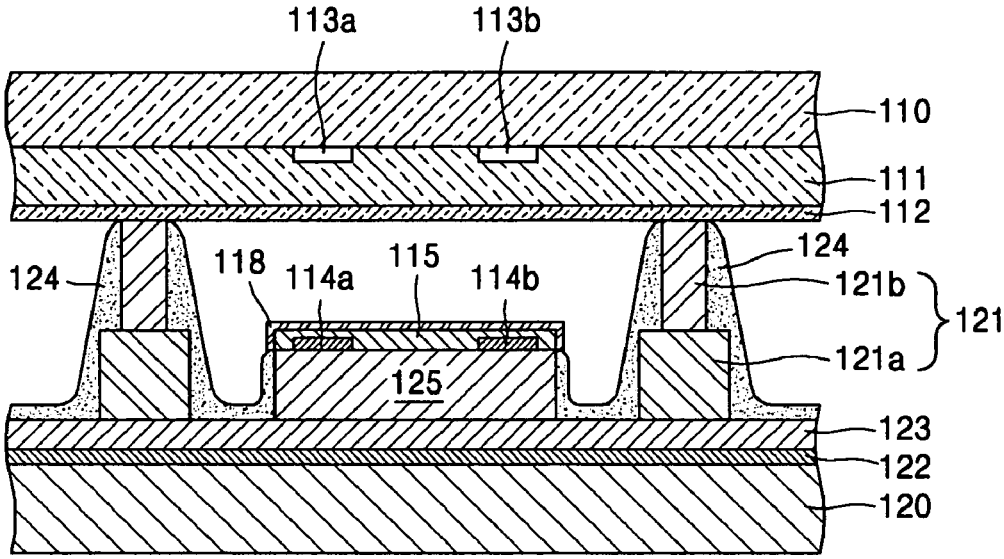
FIG. 10A is a schematic cross-sectional view of a PDP according to a third exemplary embodiment of the present invention.
Figure 10B:
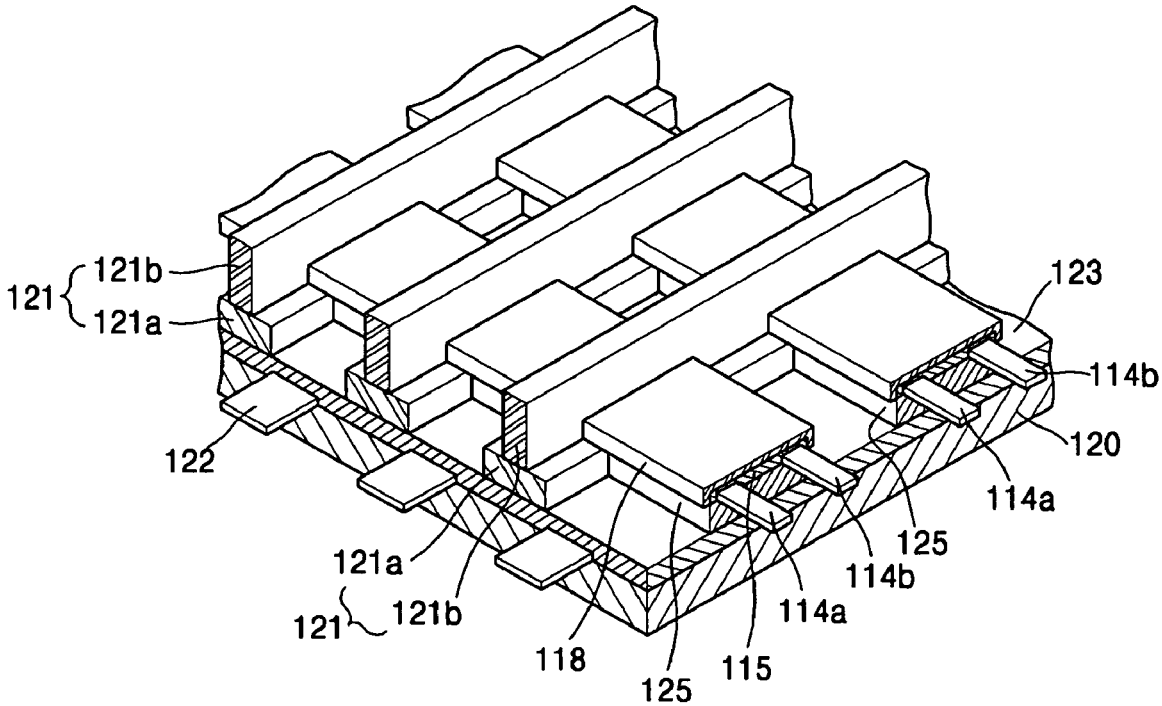
FIG. 10B is a schematics perspective view of the PDP of FIG. 10A.
Figure 11A:
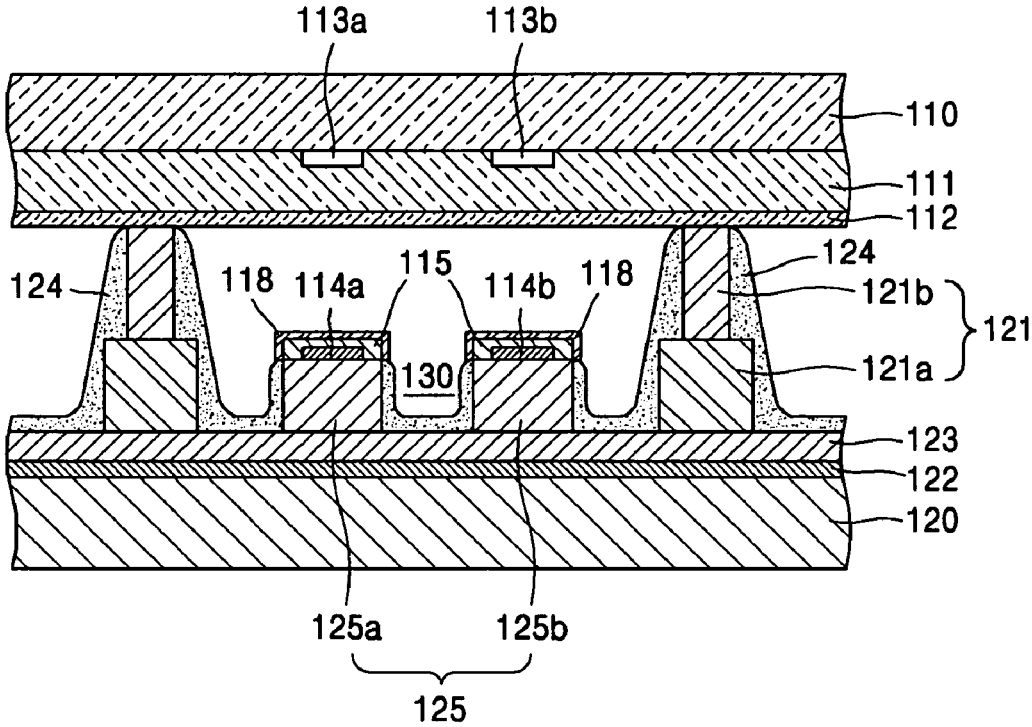
FIG. 11A is a schematic cross-sectional view of a PDP according to a fourth exemplary embodiment of the present invention.
Figure 11B:
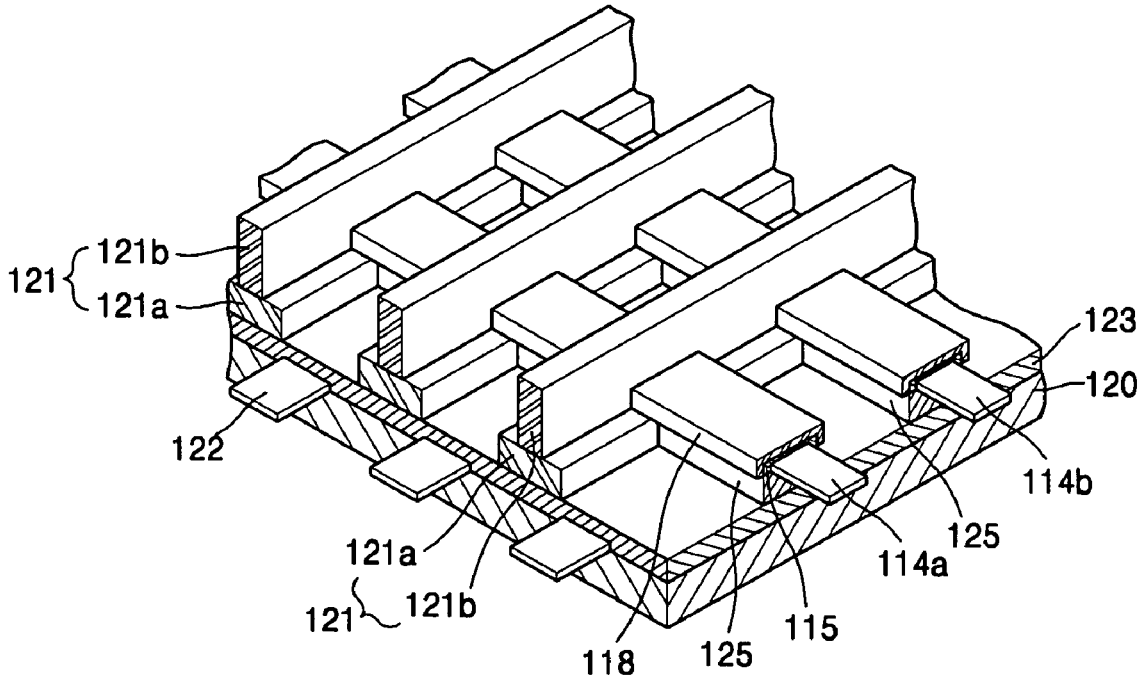
FIG. 11B is a schematics perspective view of the PDP according to FIG. 11A.

FIG. 10A and FIG. 11A illustrate PDPs according to third and fourth exemplary embodiments of the present invention, respectively, and FIG. 10B and FIG. 11B are partial perspective views showing the structures of barrier ribs 121 formed on inner surfaces of second substrates in the third and fourth exemplary embodiments, respectively.

The third and fourth exemplary embodiments shown in FIG. 10A, FIG. 10B, FIG. 11A, and FIG. 11B are modified examples of the PDPs of the first and second exemplary embodiments, and they have structures where the barrier rib 121 includes upper and lower portions 121*a* and 121*b*, rather than being formed as a single body.

Referring to FIG. 10A, FIG. 10B, FIG. 11A and FIG. 11B, the barrier rib 121 includes a lower portion 121*a* and an upper portion 121*b*. The lower portion 121*a* may be formed integrally with ridges 125, 125*a*, and 125*b*, and the upper portion 121*b* may be separately formed after forming the second discharge electrodes 114*a* and 114*b* on the ridges 125, 125*a*, and 125*b* and a second dielectric layer 115 thereon. According to the aforementioned structure, the ridges 125, 125*a*, and 125*b* are formed together with the upper portion 121*b* of the barrier rib 121 in a matrix shape. The barrier ribs 121 and the ridges 125 are illustrated to be parallel to each other in FIG. 10A and FIG. 11A to help with understanding the discharge cell structure. However, the barrier ribs 121 are substantially perpendicular to the ridges 125, as FIG. 10B and FIG. 11B show.

Figure 12A:
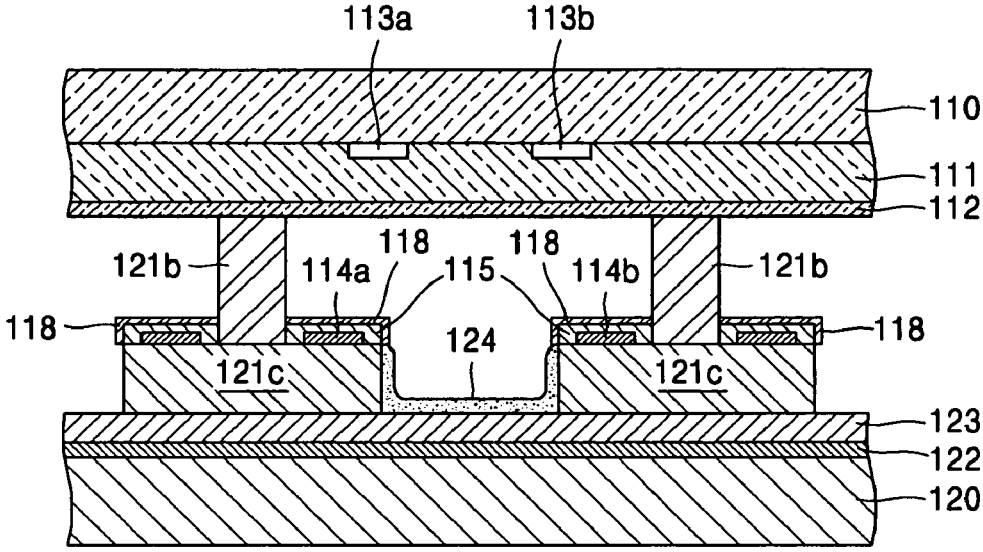
FIG. 12A is a schematic cross-sectional view of a PDP according to a fifth exemplary embodiment of the present invention.
Figure 12B:
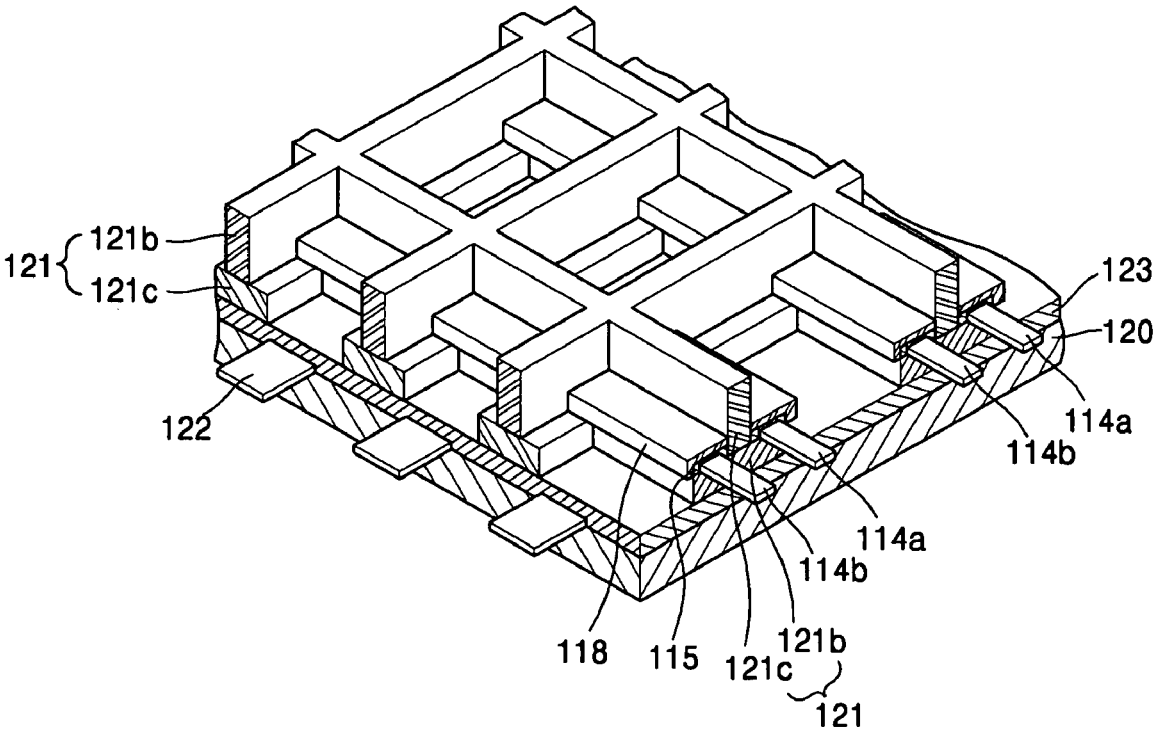
FIG. 12B is a schematics perspective view of the PDP of FIG. 12A.

FIG. 12A and FIG. 12B illustrate a PDP according to a fifth exemplary embodiment of the present invention.

Referring to FIG. 12A and FIG. 12B, the barrier rib 121 includes upper and lower portions 121*b* and 121*c*, and the lower portion 121*c* is wider than the upper portion 121*b*. The upper portion 121*b* of the barrier rib 121 is located at a central portion of the lower portion 121*c*, so that second discharge sustain electrodes 114*a* and 114*b* may be formed at a step portion of the lower portion 121*c* without being overlapped by the upper portion 121*b*. The second discharge sustain electrodes 114*a* and 114*b* that are formed on the same lower portion 121*c* are isolated by the upper portion 121*b*.

As a whole, the barrier rib 121 has a structure where the lower portion 121*c* and the upper portion 121*b* have a matrix shape and provide independent discharge cells. In the embodiment, since the second discharge sustain electrodes 114*a* and 114*b* are separated farther apart, a sufficient discharge distance may be obtained.

In the above exemplary embodiments, the position of the phosphor layer is not specifically described. The phosphor layer may be freely disposed in an allowable range in terms of an internal structure, and arrangement of the phosphor layer does not limit the scope of the present invention.

In order to evaluate a PDP according to exemplary embodiments of the present invention described above, comparative experiments were performed.

Figure 2:
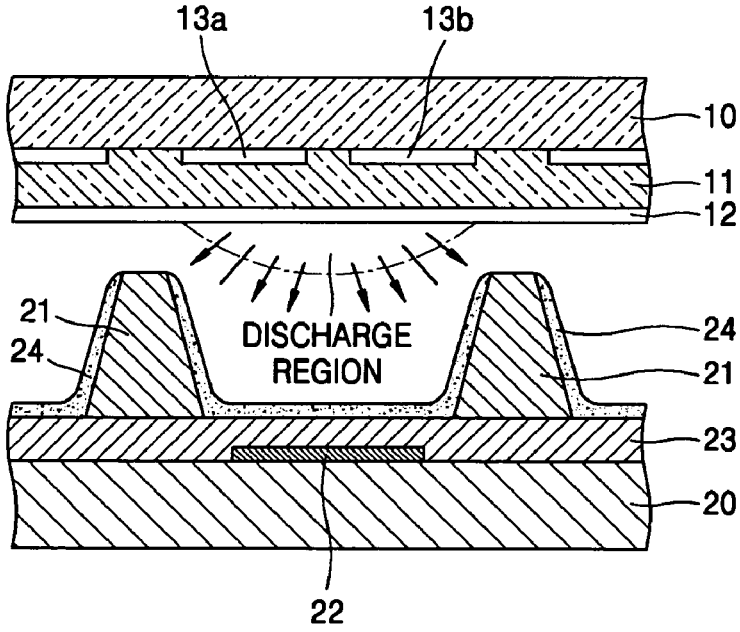
FIG. 2 (PRIOR ART)
FIG. 2 is a schematic cross-sectional view of the conventional PDP of FIG. 1.
Figure 13A:
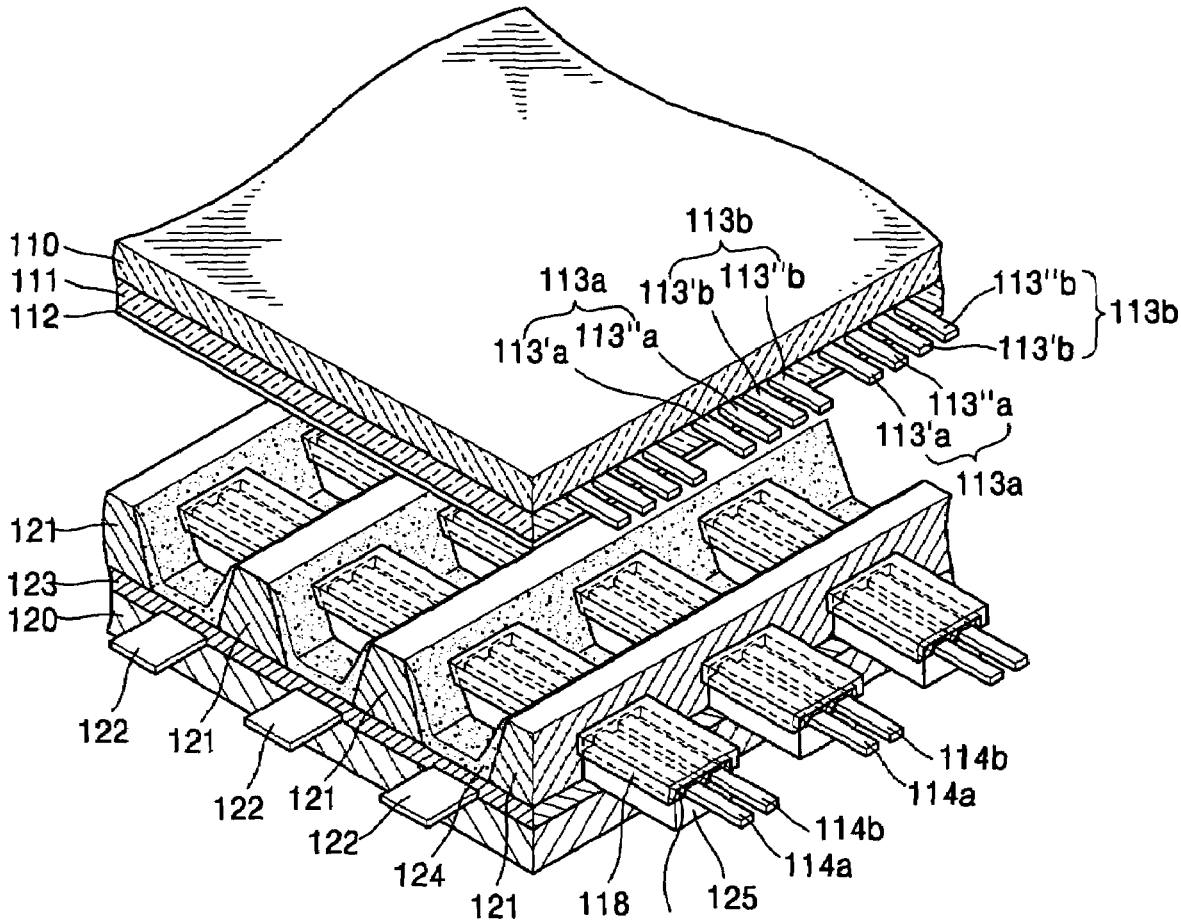
FIG. 13A is a schematic perspective view of a PDP according to a sixth exemplary embodiment of the present invention.
Figure 13B:
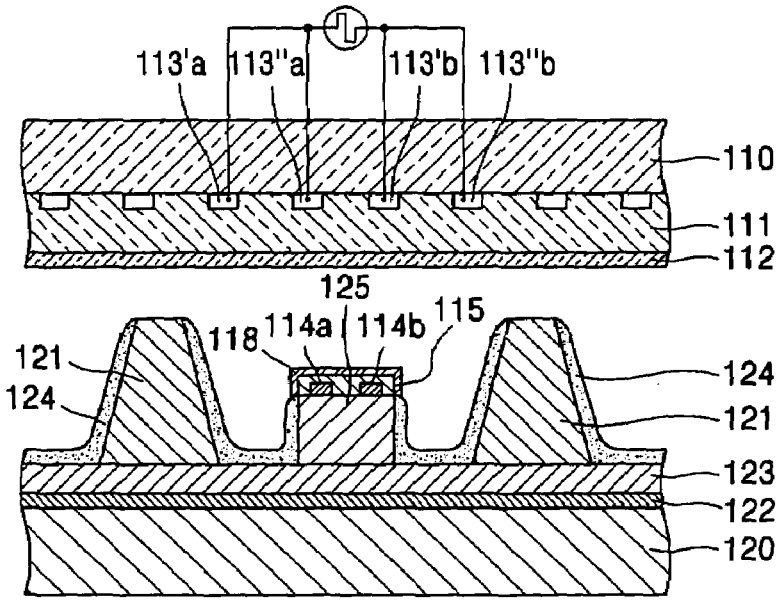
FIG. 13B is a schematic cross-sectional view of the PDP of FIG. 13A.

Sample A is a conventional three-electrode PDP of FIG. 1 and FIG. 2, Sample B is a PDP of the first embodiment of FIG. 3 and FIG. 4, Sample C is a PDP of the second embodiment of FIG. 8 and FIG. 9, and Sample D is a PDP of the sixth embodiment of FIG. 13A and FIG. 13B.

Table 1 shows discharge characteristics for Samples A, B, C and D under the same conditions.

TABLE 1

| Discharge Characteristics | Sample A (Conventional PDP) | Sample B (First Embodiment) | Sample C (Second Embodiment) | Sample D (Sixth Embodiment) |
|---|---|---|---|---|
| Discharge Initiation Voltage (Vf) | 442 V | 456 V | 412 V | 421 V |
| Sustain Discharge Voltage (Vs) | 323 V | 307 V | 303 V | 305 V |
| Brightness (cd/m$^2$) | 8.58 @ 343 V | 18.8 @ 327 V | 11.9 @ 323 V | 14.9 @ 325 V |
| Discharge Efficiency (lm/W) | 1.02 @ 343 V | 1.8 @ 327 V | 1.24 @ 323 V | 1.34 @ 325 V |

In the fifth exemplary embodiment, the gap between the first discharge sustain electrodes 113*a* and 113*b* is narrower than the gap between the second discharge sustain electrodes 114*a* and 114*b*.

FIG. 13A and FIG. 13B show a PDP according to a sixth exemplary embodiment of the present invention where each first discharge sustain electrode 113*a* and 113*b* is divided into two electrode elements 113'*a*, 113"*a* and 113'*b*, 113"*b*, respectively.

Referring to FIG. 13A and FIG. 13B, except for the first discharge sustain electrodes 113*a* and 113*b*, the sixth embodiment has a similar basic structure as that of the PDP of the first embodiment shown in FIG. 3 and FIG. 4.

Referring to FIG. 13A and FIG. 13B, a plurality of first discharge sustain electrode pairs 113*a* and 113*b*, which include two electrode elements 113'*a*, 113"*a* and 113'*b*, 113"*b*, respectively, are formed on an inner surface of the first substrate 110. The first dielectric layer 111 covers the first discharge sustain electrode pairs 113*a* and 113*b*, and the protective layer 112 covers the first dielectric layer 111. Although the electrode elements 113'*a*, 113"*a* are spaced apart from each other, they are coupled with a driving circuit so that they may have the same electric potential. The electrode elements and 113'*b*, 113"*b* have a similar arrangement so that they may have the same electric potential. The barrier ribs 121 and the ridges 125 are illustrated to be parallel to each other in FIG. 13B to help with understanding the discharge cell structure. However, the barrier ribs 121 are substantially perpendicular to the ridges 125, as FIG. 13A shows.

On the other hand, in other embodiments of the present invention, each second discharge sustain electrode 114*a* and 114*b* may include two electrode elements 114'*a*, 114"*a* and 114'*b*, 114"*b*, respectively, similar to the first discharge sustain electrodes 113*a* and 113*b*. Namely, the first discharge sustain electrodes and the second discharge sustain electrodes may each include two electrode elements.

Table 1 shows that in the case of discharge initiation voltage, Sample B has a relatively high discharge initiation voltage but a relatively low sustain discharge voltage, as well as excellent brightness and efficiency. On the other hand, Samples C and D are superior to Sample A in terms of discharge initiation voltage, discharge sustain voltage, brightness, and efficiency.

According to exemplary embodiments of the present invention, second sustain discharge electrode pairs are added to a discharge cell to provide a PDP having enhanced discharge characteristics in comparison to a conventional discharge structure.

According to embodiments of the present invention, it is possible to solve shortcomings of a conventional three-electrode surface discharge PDP and to provide a PDP capable of implementing a low discharge initiation voltage and sustain discharge voltage through a five-electrode or seven-electrode structure and having high efficiency and brightness even with such low discharge initiation voltage and sustain discharge voltage conditions as compared to a conventional three-electrode PDP.

Additionally, a PDP according to embodiments of the present invention may be suitable for a large-sized image display apparatus requiring reduced power consumption.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate and a second substrate arranged facing each other, a gap being between the first substrate and the second substrate; and a plurality of discharge cells between the first substrate and the second substrate, a discharge cell comprising a first electrode pair and a second electrode pair, wherein the first electrode pair is arranged on the first substrate and induces a mutual discharge; and wherein the second electrode pair is arranged substantially parallel to the first electrode pair and induces a mutual discharge, the second electrode pair being separated from the first electrode pair by the gap between the first substrate and the second substrate.

2. The PDP of claim 1, further comprising:

a ridge arranged in the discharge cell and on the second substrate, wherein at least one electrode of the second electrode pair is arranged on the ridge.

3. The PDP of claim 2, wherein both electrodes of the second electrode pair are arranged on the ridge.

4. The PDP of claim 2, wherein the ridge comprises a first ridge and a second ridge, and wherein a first electrode of the second electrode pair is arranged on the first ridge, and a second electrode of the second electrode pair is arranged on the second ridge.

5. The PDP of claim 1, wherein a width of a gap between electrodes of the first electrode pair is substantially equal to a width of a gap between electrodes of the second electrode pair.

6. The PDP of claim 1, wherein a gap between electrodes of the second electrode pair is narrower than a gap between electrodes of the first electrode pair.

7. The PDP of claim 1, wherein a gap between electrodes of the second electrode pair is wider than a gap between electrodes of the first electrode pair.

8. The PDP of claim 1, further comprising:

an address electrode arranged on the second substrate and in a direction substantially perpendicular to the first electrode pair and the second electrode pair.

9. The PDP of claim 1, wherein each electrode of the first electrode pair comprises two electrode elements that are spaced apart from each other and are electrically connected to each other.

10. The PDP of claim 1, further comprising:

a first dielectric layer substantially covering the first electrode pair; and a second dielectric layer substantially covering the second electrode pair.

11. The PDP of claim 10, further comprising:

a first protective layer substantially covering the first dielectric layer; and a second protective layer substantially covering the second dielectric layer.

12. A plasma display panel (PDP), comprising:

a first substrate and a second substrate arranged facing each other;

a plurality of barrier ribs arranged substantially parallel to each other and between the first substrate and the second substrate;

a first electrode pair that is arranged on the first substrate and that induces a mutual discharge;

a plurality of ridges arranged on the second substrate;

a second electrode pair that is arranged substantially parallel to the first electrode pair and that induces a mutual discharge; and an address electrode arranged on the second substrate in a direction substantially perpendicular to the first electrode pair and the second electrode pair, wherein at least one electrode of the second electrode pair is arranged on a ridge.

13. The PDP of claim 12, wherein both electrodes of the second electrode pair are arranged on the ridge.

14. The PDP of claim 12, wherein the ridge comprises a first ridge and a second ridge, and wherein a first electrode of the second electrode pair is arranged on the first ridge, and a second electrode of the second electrode pair is arranged on the second ridge.

15. The PDP of claim 12, wherein a width of a gap between electrodes of the first electrode pair is substantially equal to a width of a gap between electrodes of the second electrode pair.

16. The PDP of claim 12, further comprising:

a phosphor layer arranged at least on side walls of the ridges and a surface of the second substrate.

17. The PDP of claim 12, wherein a gap between electrodes of the second electrode pair is narrower than a gap between electrodes of the first electrode pair.

18. The PDP of claim 12, wherein a barrier rib comprises an upper portion and a lower portion, and the lower portions of the barrier ribs are formed integrally with the ridges.

19. The PDP of claim 18, wherein the lower portion is wider than the upper portion.

20. The PDP of claim 12, wherein the ridges are arranged in a direction substantially perpendicular to the barrier ribs, and the ridges are buried by the barrier ribs where the ridges and the barrier ribs intersect each other.

21. The PDP of claim 12, further comprising:

a first dielectric layer substantially covering the first electrode pair; and a second dielectric layer substantially covering the second electrode pair.

22. The PDP of claim 21, further comprising:

a first protective layer substantially covering the first dielectric layer; and a second protective layer substantially covering the second dielectric layer.

23. A plasma display panel (PDP), comprising:

a first substrate and a second substrate arranged facing each other;

a plurality of barrier ribs arranged between the first substrate and the second substrate and having a step-shaped cross section formed by a lower portion and an upper portion, the lower portion being wider than the upper portion;

a first electrode pair that is arranged on the first substrate and that induces a mutual discharge;

a second electrode pair that is arranged substantially parallel to the first electrode pair and that induces a mutual discharge; and an address electrode arranged in a direction substantially perpendicular to the first electrode pair and the second electrode pair, wherein both electrodes of the second electrode pair are arranged on the lower portion of a barrier rib.

24. The PDP of claim 23, wherein the barrier ribs form a matrix structure having first portions substantially parallel to the first electrode pair and the second electrode pair and second portions substantially perpendicular to the first electrode pair and the second electrode pair.

25. The PDP of claim 24, wherein the second electrode pair is buried by upper portions of the barrier ribs where the second electrode pair and the upper portions of the barrier ribs intersect each other.

26. The PDP of claim 23, wherein the address electrode is arranged on the second substrate.

27. The PDP of claim 23, wherein the upper portion of the barrier rib is arranged between the electrodes of the second electrode pair.

28. The PDP of claim 23, further comprising:

a first dielectric layer substantially covering the first electrode pair; and a second dielectric layer substantially covering the second electrode pair.

29. The PDP of claim 28, further comprising:

a first protective layer substantially covering the first dielectric layer; and a second protective layer substantially covering the second dielectric layer.

* * * * *